United States Patent [19]

Pobran

[11] Patent Number: 4,949,956

[45] Date of Patent: Aug. 21, 1990

[54] PULL-UP BAR EXERCISE DEVICE

[76] Inventor: David H. Pobran, 1771 Tattenham Rd., Leucadia, Calif. 92024

[21] Appl. No.: 398,378

[22] Filed: Aug. 24, 1989

[51] Int. Cl.[5] ..... A63B 1/00; A63B 23/12

[52] U.S. Cl. ..... 272/62; 272/143

[58] Field of Search ..... 272/61, 62, 109, 136, 272/112, 120, 67, 68, 109, 143; 128/25 R

[56] References Cited

U.S. PATENT DOCUMENTS

| | | | |
|---|---|---|---|
| 1,646,158 | 10/1927 | McWhirter | 272/61 |
| 2,240,407 | 4/1941 | Masters | 272/112 |
| 2,488,534 | 11/1949 | Hagerman | 272/83 |
| 2,782,033 | 2/1957 | Ugartechea | 272/67 |
| 3,233,894 | 2/1966 | Binan | 272/61 |
| 3,468,534 | 9/1969 | Donato | 272/128 |
| 3,614,097 | 10/1971 | Blickman | 272/72 |
| 4,111,414 | 9/1978 | Roberts | 272/62 |
| 4,125,257 | 11/1978 | Lew | 272/109 |
| 4,153,244 | 5/1979 | Tauber | 272/67 |
| 4,358,108 | 11/1982 | Voris | 272/118 |
| 4,552,356 | 11/1985 | Brousseau | 272/137 |
| 4,662,629 | 5/1987 | Plouie | 272/62 |
| 4,863,158 | 9/1989 | Tassone | 272/93 |

*Primary Examiner*—Randall L. Green
*Assistant Examiner*—David H. Willse
*Attorney, Agent, or Firm*—Baker, Maxham, Jester & Meador

[57] ABSTRACT

A pull-up exercise apparatus comprises a transverse bar defined by a section of iron pipe having a length of on the order of about thirty to thirty-five inches in length, and having a forty-five degree elbow on each end, a length of pipe of about four to six inches in length secured in each forty-five degree elbow for defining at least two hand grips of different orientation, a length of chain extending through the bore of the pipe, and a pair of hooks for adjustably supporting the chain and the bar at multiple selected positions from an overhead structure.

12 Claims, 1 Drawing Sheet

PULL-UP BAR EXERCISE DEVICE

BACKGROUND OF THE INVENTION

The present invention relates to exercise equipment and pertains particularly to an improved pull-up bar.

The benefits of exercise to the health and well being of a person is well known. However, the means and opportunity for effective exercise is not readily available to everyone.

Many different devices have been developed over the years to enable persons to perform many different exercises. Most of these devices are complicated, expensive and suitable only for use in a gym. Accordingly, they are not readily available to the average person.

The pull-up or chin-up exercise is one of the simplest and most effective exercises for the upper body, particularly the back muscles. However, the traditional portable pull-up bars, which are wedged in doorways, are not reliable and usually cannot be properly adjustable. Also, they are quite limited in the variation of use.

It is desirable that a simple and effective exercise device be available to enable a person to make the most of the pull-up type of exercise.

SUMMARY AND OBJECTS OF THE INVENTION

It is the primary object of the present invention to provide an improved pull-up apparatus.

In accordance with a primary aspect of the present invention, a pull-up bar exercise device includes an elongated bar with multiple number of different angle and position grips for enhancing pull-up exercises, and means for selectively adjusting the height of the bar.

DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
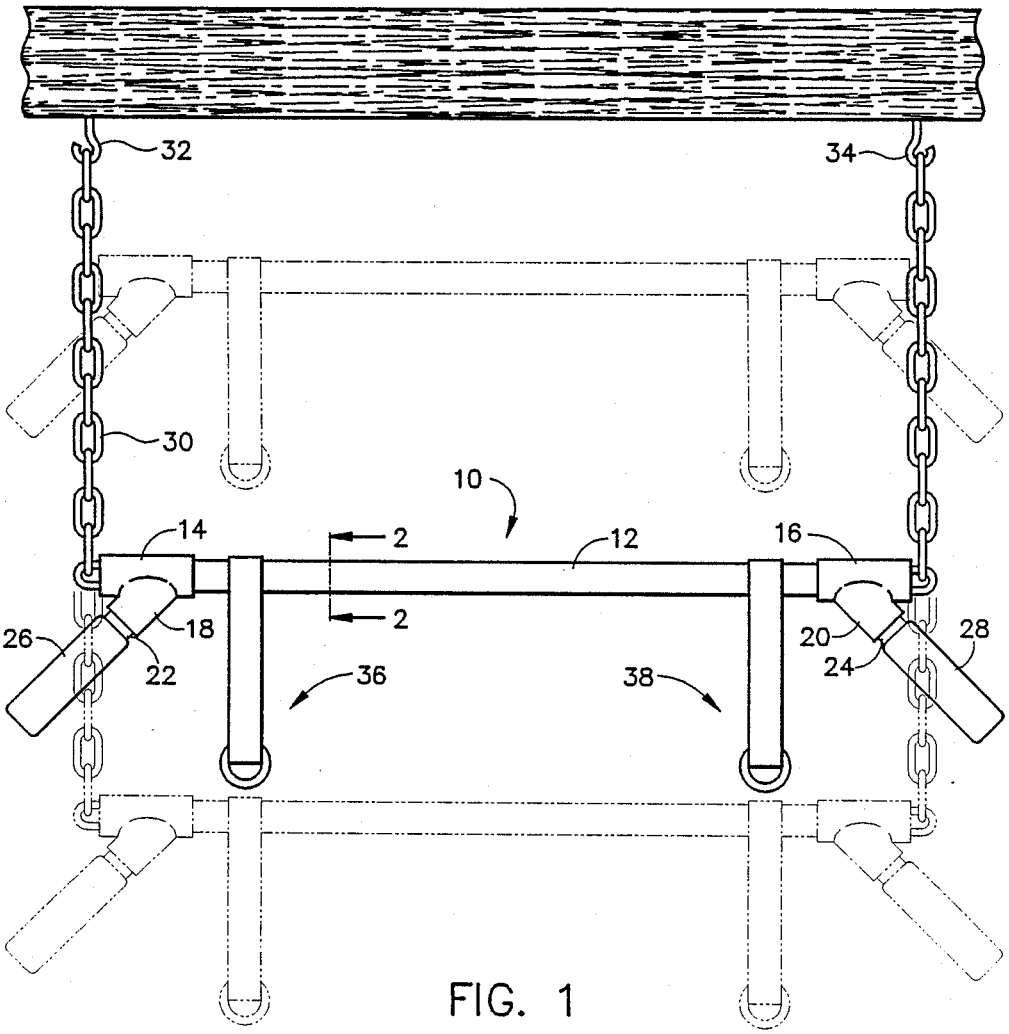
FIG. 1 is a front elevation view of a preferred embodiment of the invention showing multiple positions of adjustment.
Figure 2:
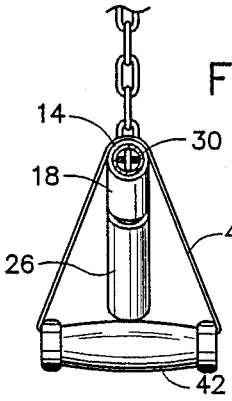
FIG. 2 is a section view taken generally on line 2—2 of FIG. 1.
Figure 3:
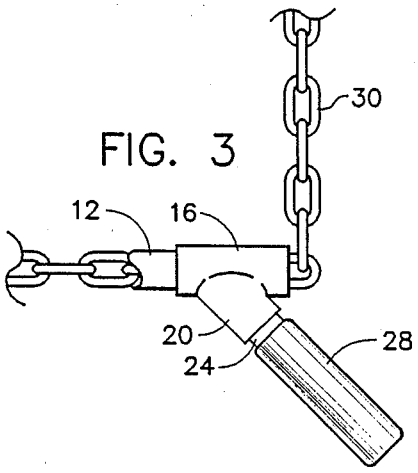
FIG. 3 is an enlarged detailed view of a grip portion of the embodiment of FIG. 1.

Referring to the drawing, and particularly to FIG. 1, there is illustrated an exemplary embodiment of a pull-up bar apparatus or assembly in accordance with the invention, designated generally by the numeral 10. The apparatus comprises a central elongated tubular bar 12, having a length of about thirty to thirty-six inches, a diameter of about one inch, and a throughbore of about three-quarters to seven-eights. A section of iron pipe, such as gas or water pipe, has been found to be suitable.

The central section 12 is preferably threaded at each end for receiving a pair of forty-five degree angle Y-couplings 14 and 16. Each of the Y-couplings 14 and 16 comprise a central cylindrical body section, and an outward extending arm 18 and 20, respectively, at an angle of about forty-five degrees to the central body. Into these are threaded a nipple 22 and 24 for defining handles or grips. Each of the nipples is a short length of iron pipe on the order of about five to six inches in length and covered by a foam or other suitable grip 26 and 28.

The bar assembly is supported from overhead support structure, such as ceiling joists or the top of a doorway, by means of a length of chain 30 or other suitable flexible member. The chain 30 is detachably connected by means of a pair of hooks 32 and 34 that enable the height of the bar to be adjusted to different levels as indicated. The chain is on the order of about fourteen feet in length and of a diameter to fit through the throughbore of the bar 12. This enables the bar to be adjusted in height by altering the position of the chain to one of the hooks. The chain is preferred over other forms of flexible members, such as cables and the like, because the links keep the bar from slipping on the chain should it become unevenly loaded.

An additional set of hand grips in the form of a pair of straps, each with a hand grip portion, is looped over the bar and may be selectively positioned along the bar. Each of these grip units 36 and 38 comprise a strap 40 of high strength webbing material of about twenty-four inches in length extended through a plastic pipe section of about four inches in length and about one inch in diameter. The pipe section is covered with a suitable foam, rubber, or the like hand grip.

The above described assembly provides a multi-level pull-up bar assembly having three sets of hand grips at different angles, with one being selectively adjustable in position relative to the bar. The different hand grips enable different groups of muscles to be emphasized in an exercise routine, using the hands to pull or push at different angles to the body. The height adjustment enables the height to be adjusted to restrict the exercise to the upper body or to combine upper and lower body exercises.

The central section of the bar enables exercises with the hands facing toward or away from the body and spaced close in or out from the body. These can be used in conjunction with different heights of the bar wherein the bar may be of a height that the body is supported solely by the arms. Alternatively, the bar may be at a height that the legs can also be used to assist in pull-ups, where the arms are too weak to perform a pull-up, or simply to combine the two. The user may also lie on a bed or floor in a horizontal position and pull himself up with support at the heels. Other arrangements may also be used.

The angle grips 26 and 28 at the other end of the bar may be similarly used, but because of the outward angle, emphasis is placed on different sets and different directions of use of muscles in the back. The hands would normally face outward or forward from the body only and the pull of the back muscles would be a combination of inward and down.

The strap grips 36 and 38 add even more versatility to the overall apparatus. The straps can serve some of the functions of acrobatic rings and enable a number of at least modified acrobatic maneuvers. The hands would normally grasp the grips facing one another and can be twisted to other orientations. The straps can also be adjustably positioned at a number of selected positions along the bar. These also enable one to exercise while in the inverted position, thus exercising different muscles than from the normal vertical position.

While I have illustrated and described my invention by means of specific embodiments, it is to be understood that the scope of the invention is to be limited only by the scope of the appended claims.

I claim:

1. A pull-up exercise apparatus comprising in combination:

an elongated transverse bar having a straight section terminating at opposite ends, and grip means including at least two pairs of hand grips of different orientation, one of said pair of grips including a pair of spaced apart grips rigidly attached to and extending outward from said bar intermediate the ends thereof at a forty-five degree angle to the axis thereof; and means at said opposite ends for adjustably supporting said bar at multiple selected height positions from an overhead structure.

2. A pull-up apparatus according to claim 1 wherein:

said grip means includes a pair of spaced apart straps extending across said bar and having hand grips therewith normally disposed at a ninety degree angle to the axis of said bar.

3. A pull-up apparatus according to claim 1 wherein:

said bar is tubular; and said means for adjustably supporting said bar comprises an elongated chain extending through said bar, and a pair of hooks for adjustably supporting said chain.

4. A pull-up apparatus according to claim 1 wherein:

said bar is a section of iron pipe having a length of on the order of about thirty to thirty-five inches in length having a forty-five degree elbow on each end;

said one of said grip means comprises a length of pipe of about four to six inches in length secured in said forty-five degree elbow; and said means for adjustably supporting comprises an elongated chain having a length of on the order of about twelve to sixteen feet extending through said bar, and a pair of hooks for adjustably supporting said chain from an overhead structure.

5. A pull-up apparatus according to claim 4 wherein:

said grip means includes a pair of spaced apart straps extending across said bar and having hand grips therewith normally disposed at a ninety degree angle to the axis of said bar.

6. A pull-up apparatus according to claim 5 wherein:

said straps are on the order of about twenty-four inches in length and formed of a length of high strength webbing; and said grips are sections of pipe of about four inches in length through which said straps extend.

7. A pull-up exercise apparatus comprising in combination:

a transverse bar defined by a section of iron pipe having a length of on the order of about thirty to thirty-five inches in length, a forty-five degree Y-coupling detachably secured on each end of said iron pipe, a length of pipe of about four to six inches in length secured in each of said forty-five degree Y-couplings for defining at least two hand grips of different orientation; and means including a length of chain extending through the bore of said pipe and a pair of hooks for adjustably supporting said chain and said bar at multiple selected positions from an overhead structure.

8. A pull-up apparatus according to claim 7 further comprising a pair of spaced apart straps extending across said bar and having hand grips therewith normally disposed at a ninety degree angle to the axis of said bar.

9. A pull-up apparatus according to claim 8 wherein:

said straps are on the order of about twenty-four inches in length and formed of a length of high strength webbing; and said grips are sections of pipe of about four inches in length through said straps extend.

10. A portable pull-up exercise apparatus comprising in combination:

an elongated transverse bar defined by a section of iron pipe having open ends and a length of about thirty to thirty-five inches for defining a first pair of hand grips;

a forty-five degree angle Y-coupling detachably secured on each end of said iron pipe for maintaining said open ends, and a length of pipe of about four to six inches in length secured in each of said forty-five degree elbows for defining a second pair of hand grips disposed at about forty-five degrees to said bar; and means including a length of chain slideably extending through the bore and out the open ends of said pipe, and a pair of hooks for adjustably supporting said chain and said bar at multiple selected height positions from an overhead structure.

11. A portable pull-up apparatus according to claim 10 further comprising:

a pair of spaced apart straps extending across said bar and each having a hand grip therewith normally disposed at a ninety degree angle to the axis of said bar.

12. A pull-up apparatus according to claim 11 wherein:

said straps are on the order of about twenty-four inches in length and formed of a length of high strength webbing; and said grips are sections of pipe of about four inches in length through which said straps extend.

* * * * *